US006813861B2

(12) United States Patent
Petty

(10) Patent No.: US 6,813,861 B2
(45) Date of Patent: Nov. 9, 2004

(54) RELEASABLE WINDOW GUARD

(76) Inventor: Mary A. Petty, 214 Los Lomas Ct., San Angelo, TX (US) 76904

( * ) Notice: Subject to any disclaimer, the term of this patent is extended or adjusted under 35 U.S.C. 154(b) by 0 days.

(21) Appl. No.: 10/394,340

(22) Filed: Mar. 21, 2003

(65) Prior Publication Data

US 2004/0182006 A1 Sep. 23, 2004

(51) Int. Cl.[7] ..... E06B 3/68; E05B 65/04; E05B 65/06

(52) U.S. Cl. ..... 49/56; 49/394; 49/67

(58) Field of Search ..... 49/56, 394, 50, 49/61, 63, 67, 504, 505, 463; 292/DIG. 20, 24, 57, 95, 130, 183; 52/202, 203, 204.51

(56) References Cited

U.S. PATENT DOCUMENTS

| | | | | |
|---|---|---|---|---|
| 1,573,194 A | | 2/1926 | Roe | |
| 1,973,645 A | | 9/1934 | McGilvray | |
| 2,611,933 A | * | 9/1952 | Comfort | 49/57 X |
| 2,668,729 A | | 2/1954 | Watters | |
| 2,734,601 A | * | 2/1956 | Anderson | 52/204.51 |
| 3,953,939 A | | 5/1976 | Klein | |
| D269,380 S | | 6/1983 | d' Avila | |
| D275,703 S | | 9/1984 | De Rocher | |
| 4,475,309 A | | 10/1984 | Porter | |
| 4,478,002 A | | 10/1984 | English | |
| 4,575,965 A | | 3/1986 | Iversen | |
| 4,630,396 A | | 12/1986 | Zvi et al. | |
| 4,631,862 A | | 12/1986 | Gallardo | |
| 4,631,863 A | | 12/1986 | White | |
| D299,757 S | | 2/1989 | Kluge | |
| 4,835,906 A | | 6/1989 | Collin | |
| 4,848,030 A | | 7/1989 | Bennett | |
| 5,103,591 A | * | 4/1992 | Szymanski | 49/379 |
| D336,340 S | | 6/1993 | Medina | |
| D341,210 S | | 11/1993 | Zvi | |
| 5,289,655 A | | 3/1994 | Marmora et al. | |
| D345,806 S | | 4/1994 | Vyvoda | |
| 5,325,629 A | | 7/1994 | Hsu | |
| 5,428,924 A | | 7/1995 | Pifer | |
| 5,657,578 A | | 8/1997 | Thompson | |
| 5,934,020 A | | 8/1999 | McCracken | |
| 6,216,391 B1 | | 4/2001 | Garrett, Jr. | |
| 6,434,985 B1 | * | 8/2002 | Walmsley | 70/277 |
| 6,506,112 B1 | * | 1/2003 | Halbleib et al. | 454/225 |

FOREIGN PATENT DOCUMENTS

| | | |
|---|---|---|
| DE | 930281 | 7/1955 |
| FR | 779207 | 4/1935 |

* cited by examiner

*Primary Examiner*—Hugh B. Thompson, II
(74) *Attorney, Agent, or Firm*—Dennis T. Griggs

(57) ABSTRACT

A quick release security grating is coupled to a retention frame by a hinge assembly which permits swinging movement from a closed position preventing intrusion through the window opening to an open position allowing emergency exit of an occupant through the window opening. The security grating is held in the closed position by a quick release latch assembly which is locked by an actuator arm urged by the force of gravity into locking engagement with a latch receiver. The actuator arm includes a handle which is concealed behind the retention frame when the security grating is in the closed position, making the handle immediately accessible to an occupant inside the building structure and hiding it from an intruder. A utility hook is attached to the handle and overlaps the window opening at an easy-to-find location relative to the window opening when the security grating is closed and the actuator arm is in the locked position. The utility hook serves as a reference point for quickly locating the handle to release the latch for emergency exit during hours of darkness or when the room is filled with smoke under zero visibility conditions.

15 Claims, 5 Drawing Sheets

RELEASABLE WINDOW GUARD

BACKGROUND OF THE INVENTION

This invention relates generally to security gratings for windows, and in particular to a quick-release security guard assembly for indoor installation.

Security gratings of various designs are intended to prevent intrusion and to improve the exterior appearance of homes and business establishments. In many cases, external security bars installed on doors and windows have prevented families from escaping a fire and have impeded rescue attempts by firefighters. When security bars are installed externally, rescue personnel must use the "jaws of life" or the K-12 saw to remove the bars. In some installations, it is necessary to pull the bars with a chain and fire truck during structural fires. These methods have proven to be too slow, sometimes with tragic results. Although the trend of fire deaths in general is decreasing, fire deaths relating to permanent security bar installations are on the rise.

Security bars, when installed on the inside without quick-release mechanisms, can trap the occupants during fires and make rescue impossible. This has led to government regulations that prohibit the installation or maintenance of security bars on any residential dwelling if they will not open from the inside. When installed on the inside, security bars are still considered unsafe if they require a key, special training, a separate tool or extra physical effort to open. Many building codes require that security bars when installed over exit doors or windows of sleeping rooms must be equipped with a quick-release device that allows them to be opened quickly from the inside without the use of special equipment, special knowledge or unusual physical effort.

When properly installed, removable security bars are highly effective deterrents to intrusion through windows and door openings. Preferably, the security bar assembly is installed on the interior side of the window or doorway, and can be removed by a simple means such as a latch or foot pedal release. All mounting hardware, including the release mechanism, should be concealed or obscured from view from the outside. Moreover, the release mechanism should be easy to locate and operate under conditions of darkness, i.e., in a smoke-filled room with zero visibility.

BRIEF SUMMARY OF THE INVENTION

The quick release security guard assembly of the present invention is intended for installation in a protective position adjacent a window opening in a building structure, for example a window in a sleeping room of a residential dwelling. The security guard assembly includes a metal retention frame that is dimensioned for attachment inside the window frame bordering the window opening. A removable security grating is coupled to the retention frame by a hinge assembly which permits swinging movement of the security grating from a closed position that blocks intrusion, to an open position allowing emergency exit through the window opening. The security grating is held in the closed position by a quick release latch assembly. The latch assembly is locked by an actuator arm that is held in place by the force of gravity in locking engagement with latch receivers carried by the retention frame and the security grating. The latch receivers are held in latching alignment with each other when the security grating is in the closed position. The latch assembly is released simply by lifting the actuator arm out of engagement from the latch receivers, allowing the security grating to be swung open to the emergency exit position.

In the preferred embodiment, the actuator arm includes a handle that overlaps the retention frame when the security grating is in the closed position, whereby the handle is readily accessible to an occupant inside the building, but the handle is concealed and cannot be observed through the window opening from a location external of the building. A utility hook is attached to the handle and overlaps the window opening at an easy-to-find location relative to the window opening when the security grating is closed and the actuator arm is in the locked position. By this arrangement, the utility hook and handle can be quickly located and operated by the occupant to release the latch during an emergency that may arise during hours of darkness or when the room is filled with smoke under zero visibility conditions.

The utility hook can be used in the conventional way to suspend ornamental objects or living plants in the window space. When so used, the utility hook does not give away the presence of the releasable security grate or the latch assembly. If the installation includes an additional window opening, a fixed security grating is installed over the additional window opening and a fixed utility hook is also installed at a corresponding location on the fixed security grating, thereby providing a uniform appearance when viewed externally. By this arrangement, a potential intruder would not have any basis to differentiate one window with respect to the other, and thus would not be likely to notice the location of the releasable security grating or the release apparatus.

BRIEF DESCRIPTION OF THE DRAWING

The accompanying drawing is incorporated into and forms a part of the specification to illustrate the preferred embodiments of the present invention. Various advantages and features of the invention will be understood from the following detailed description taken in connection with the appended claims and with reference to the attached drawing figures in which:

DETAILED DESCRIPTION OF THE INVENTION

Figure 1:
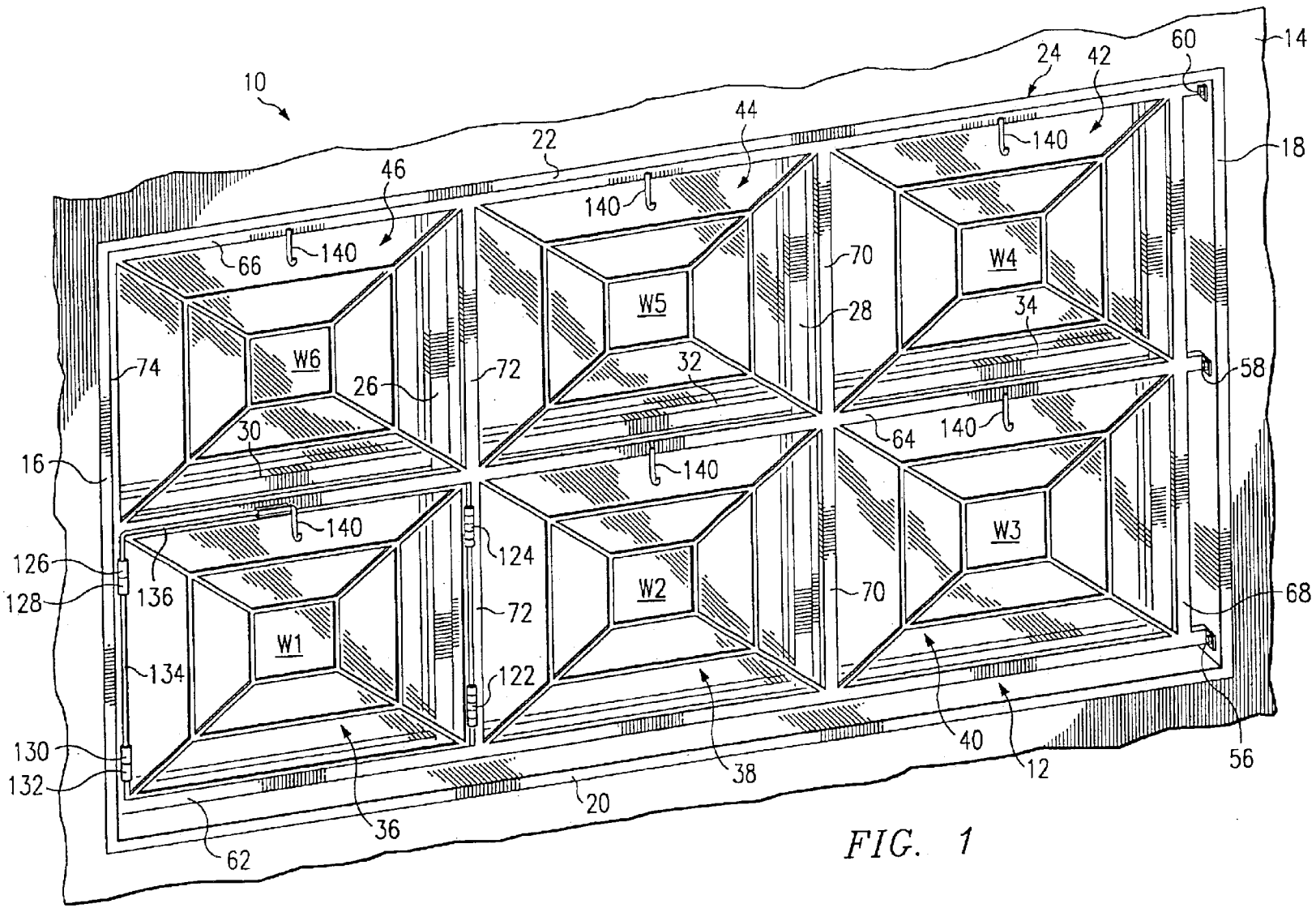
FIG. 1 is a front perspective interior view of a security guard assembly installed in a protective, locked position adjacent a window opening in a building structure.

Preferred embodiments of the invention will now be described with reference to various examples of how the invention can best be made and used. Like reference numerals are used throughout the description and several views of the drawing to indicate like or corresponding parts.

Referring now to FIG. 1, a window guard 10 constructed according to the present invention is installed in a protective position adjacent a window opening 12 formed in a building structure 14. In the illustrated embodiment, the building structure is a wall of a residential dwelling and the window opening 12 is framed by a left jamb 16, a right jamb 18, a lower sill 20 and an overhead lintel 22, which collectively form a rectangular window frame 24. The window opening 12 is partitioned by vertical stiles 26, 28 and horizontal sash bars 30, 32 and 34, thereby forming six separate window spaces W1, W2, W3, W4, W5 and W6. Glass window panes are fitted between the sash bars and stiles according to conventional construction, thus forming an array of double-hung windows. The lower windows W1, W2 and W3 are mounted in channels for sliding vertical movement, according to conventional double-hung window construction. The upper windows W4, W5 and W6 are fixed, and cannot be raised or lowered, all according to conventional window construction.

In the embodiment shown in FIG. 1, the security guard 10 includes a releasable security grating 36 installed adjacent one of the lower double-hung windows, for example window W1. Fixed security gratings 38, 40, 42, 44 and 46 are installed adjacent the remaining window spaces. The releasable security grating 36 and the fixed security gratings are attached to and supported by a retention frame 48. The retention frame 48 is dimensioned for installation within the window opening 12 and is inset from the window frame 48 when installed in the protective position shown in FIG. 1. The retention frame is equipped with offset mounting flanges 50, 52, 54, 56, 58 and 60 that are attached directly to the window frame 48 by lag screws.

The retention frame 48 includes horizontal retention bars 62, 64 and 66 and vertical retention bars 68, 70, 72 and 74 that are interconnected to form a rectangular grid, with an intermediate retention frame being formed around a substantial portion of each window opening. The retention frame 48 provides a stable platform which supports the releasable security grating 36 and the fixed security gratings 38, 40, 42, 44 and 46.

Figure 2:
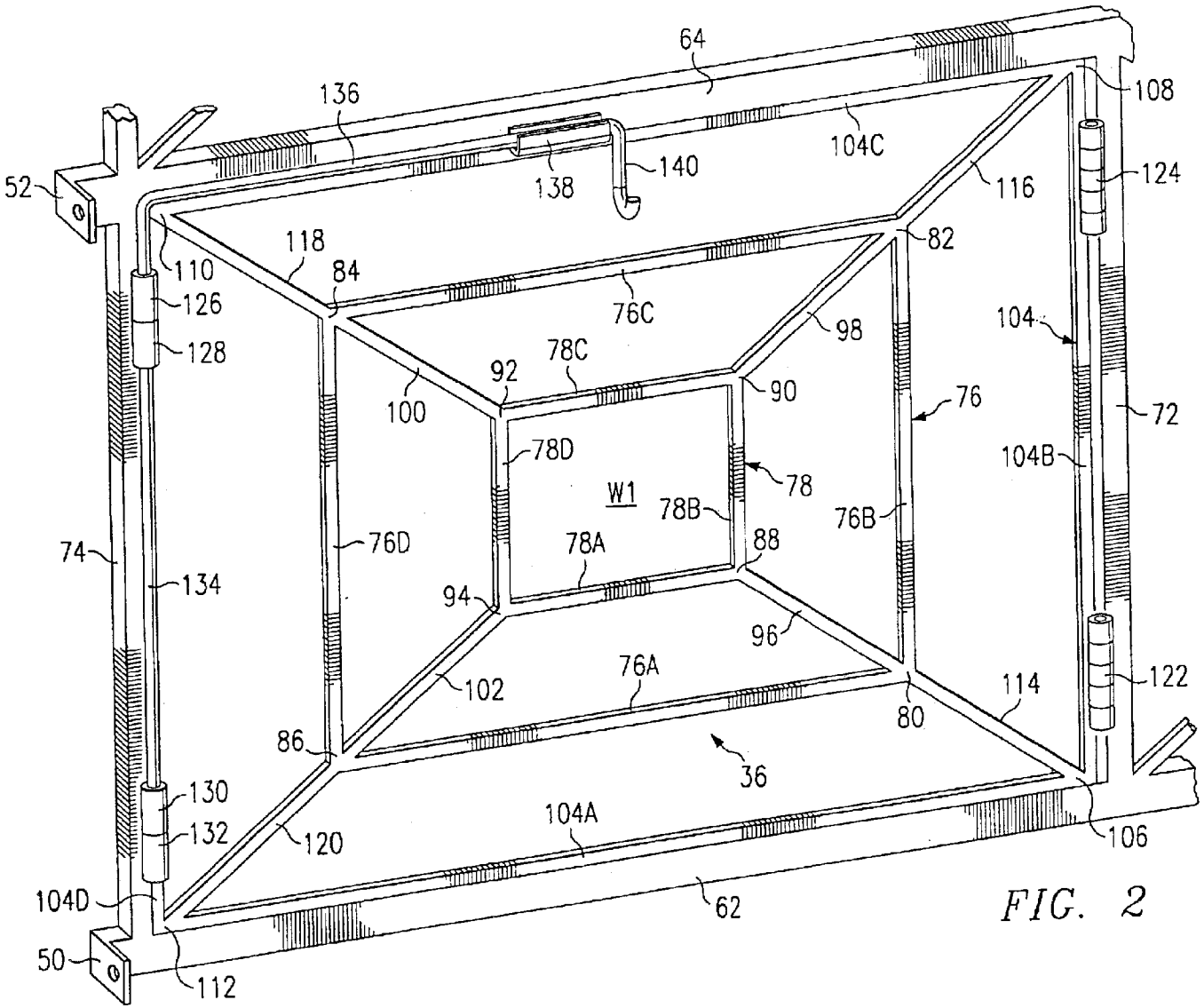
FIG. 2 is a perspective view of a releasable security grating and latch assembly which form a part of the quick release security guard shown in FIG. 1.
Figure 3:
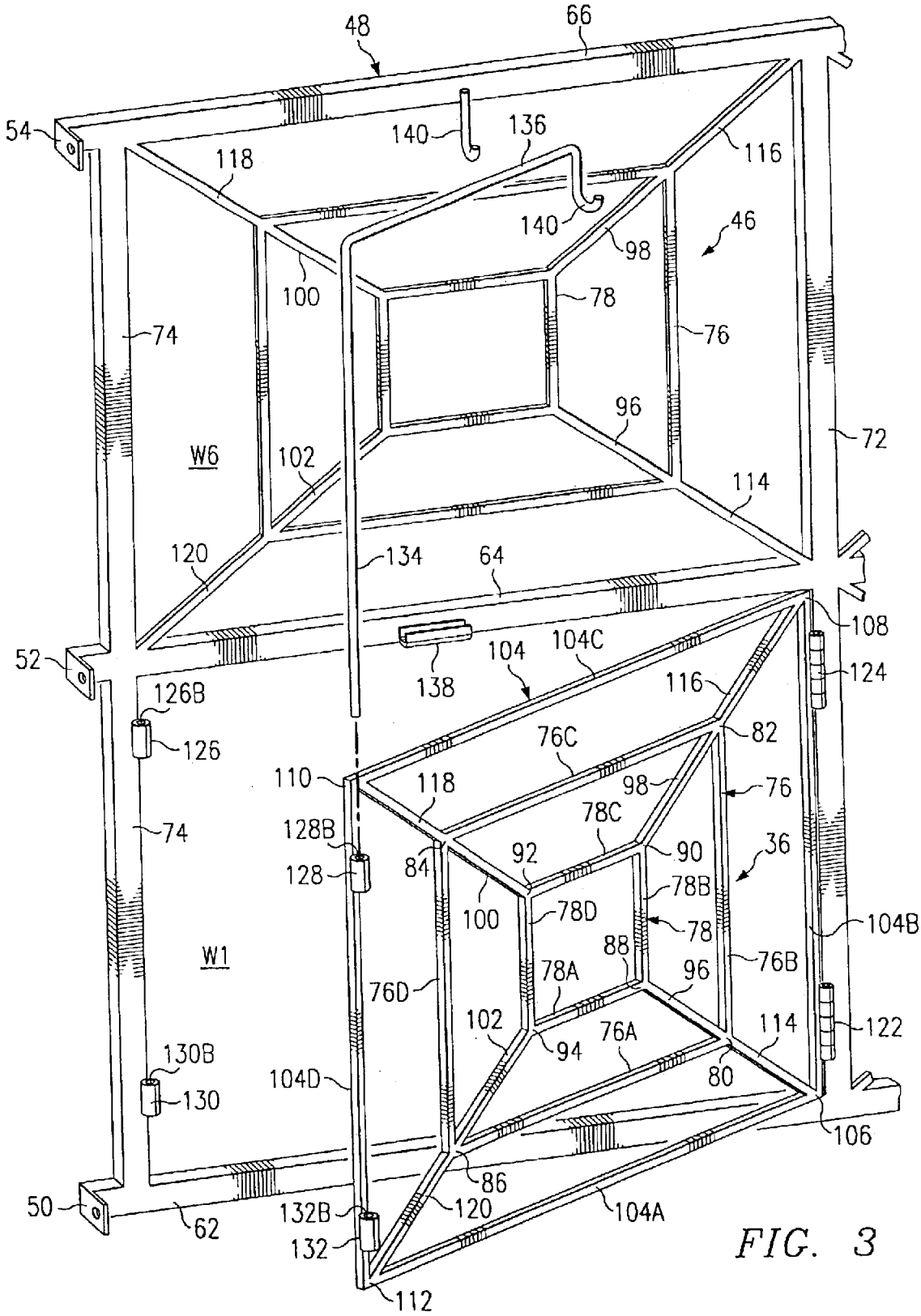
FIG. 3 is a perspective view of the security grating, shown in the released, swing-away emergency exit position.

Referring now to FIG. 2 and FIG. 3, the releasable security grating 36 and the fixed security gratings have virtually identical construction. In the preferred embodiment, each security grating includes first and second guard frames 76, 78 that are arranged in radially spaced, nested relation with each other. Generally, each guard frame includes frame segments joined together in end-to-end relation thereby forming a polygon with three or more corners. In the exemplary embodiment shown in FIG. 2 and FIG. 3, the guard frame 76 includes frame segments 76A, 76B, 76C, 76D joined together at four corners 80, 82, 84 and 86. Likewise, the innermost guard frame 78 includes four frame segments 78A, 78B, 78C and 78D joined together in end-to-end relation thereby defining a smaller rectangle having four corners 88, 90, 92 and 94. The innermost guard frame 78 is connected to the outermost guard frame 76 by linking bars 96, 98, 100 and 102 that join the diagonally adjacent corners 80, 88; 82, 90; 84, 92; 86, 94; respectively.

Since the releasable grating 36 is movable with respect to the retention frame 48, it is attached to an intermediate retention frame 104 which is dimensioned to fit within the rectangular window space W1. The intermediate retention frame includes four frame segments 104A, 104B, 104C and 104D that are joined together in end-to-end relation thereby defining four corners 106, 108, 110 and 112.

The security grating 36 is centered in radially spaced, nested relation within the intermediate retention frame 104, and is connected thereto by linking bars 114, 116, 118 and 120 which join the diagonally adjacent corners 80, 106; 82, 108; 84, 110 and 86, 112, respectively. This produces a pattern of three nested rectangular frames.

Figure 4:
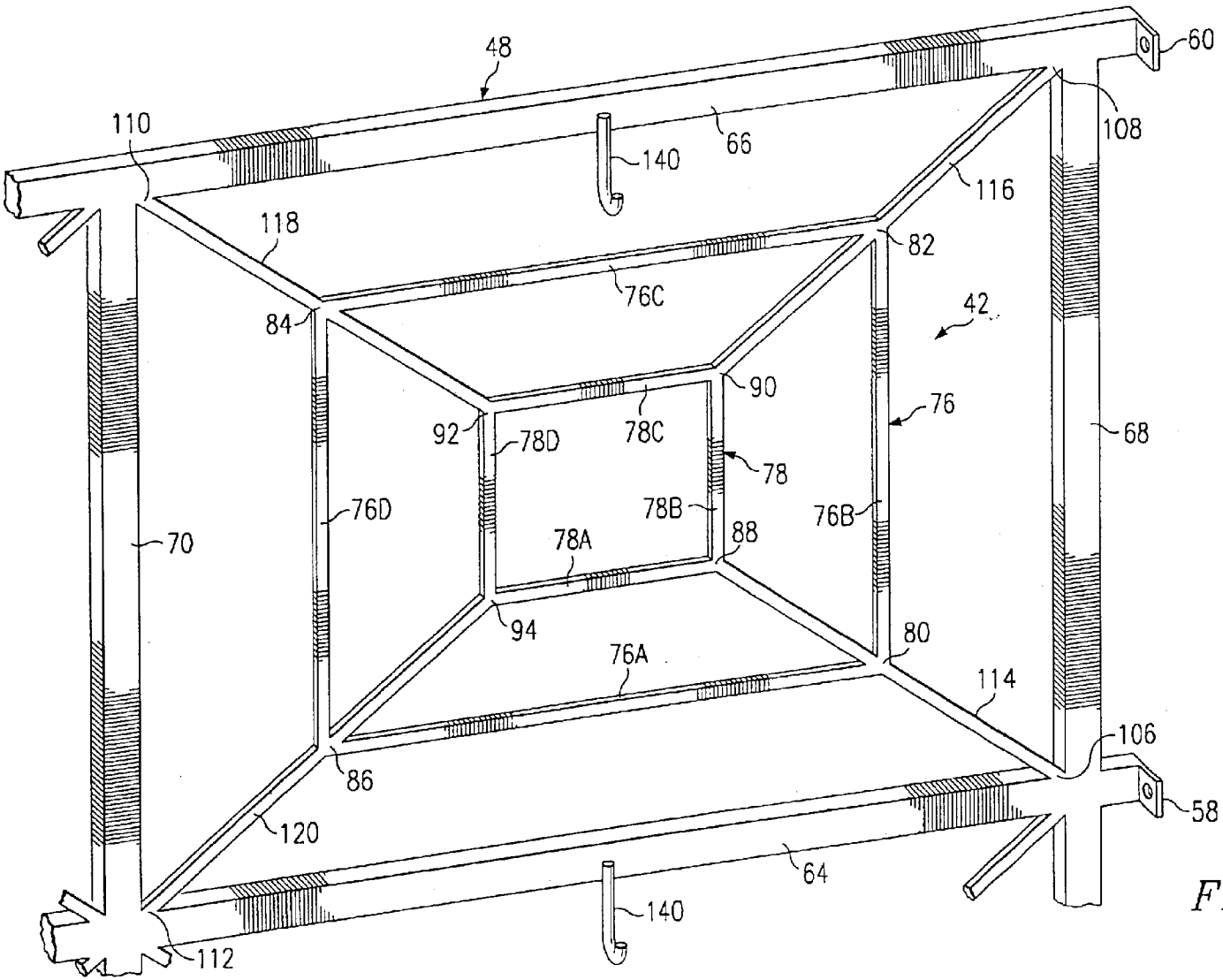
FIG. 4 is a perspective view of a fixed security grating which overlies a portion of the window opening shown in FIG. 1.
Figure 5:
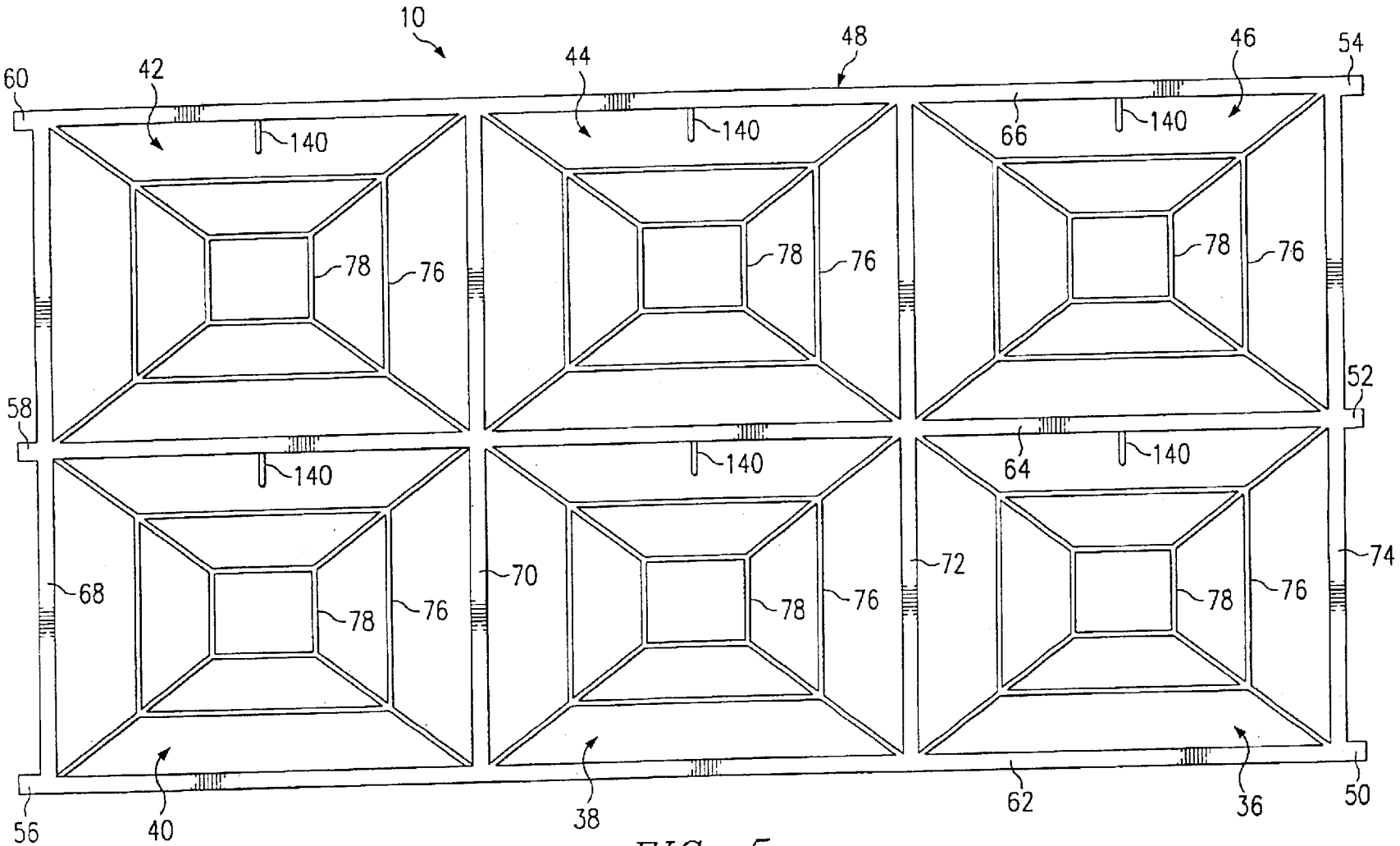
FIG. 5 is a front elevational view of the security guard assembly as viewed by an observer looking through the window opening from a location external of the building structure.

Referring now to FIG. 3 and FIG. 4, the fixed security grating 46 and the fixed security grating 42 have identical construction, and are joined directly to the retention frame 48 by the linking bars 114, 116, 118 and 120. The fixed security grating 46 is centered within a rectangular retention frame formed by the intersection of the horizontal retention bars 64, 66 with the vertical retention bars 72, 74, thus yielding a pattern of three rectangular guard frames disposed in radially spaced, nested relation with each other. When viewed externally, as shown in FIG. 5, the releasable and fixed security gratings all appear to have identical construction.

Referring again to FIG. 2 and FIG. 3, the releasable security grating 36 together with the intermediate retention frame 104 are movably coupled to the vertical retention bar 72 of the main retention frame 48 by a pair of hinges 122, 124 that permit swinging movement of the security grating 36 from a closed position (as shown in FIG. 2) in which the security grating blocks intrusion through the window opening to an open position (shown in FIG. 3) permitting emergency exit through the window opening.

The security grating 36 is releasably locked to the retention frame 48 in the closed position by a latch assembly including a first latch receiver 126 coupled to the retention frame 48 and a second latch receiver 128 coupled to the security grating. The first latch receiver 126 is welded onto the vertical retention bar 74 of the main retention frame 48, and the second latch receiver 128 is welded onto the intermediate retention frame 104. When the security grating 36 is in the closed position as shown in FIG. 2, the latch receivers 126, 128 are positioned in latching alignment with each other.

The latch receivers 126, 128 are formed by first and second tubular sleeves that are held in coaxial alignment with each other so that a latching actuator rod can be inserted through their aligned bores 126B, 128B as shown in FIG. 3. For the purpose of providing additional locking strength, a second set of latch receivers 130, 132 are likewise attached to the security grating and the retention frame in coaxial alignment with the latch receivers 126, 128 with their cylindrical bores 130B, 132B being held in alignment when the security grating is in the closed position as shown in FIG. 2.

An actuator arm 134 hangs vertically and extends through the aligned bores of the latching receivers, thereby providing locking engagement of the security grating 36 with the fixed retention frame 48. The actuator arm 134 functions as a latching rod that prevents separation of the security grating 36 from the retention frame when it is in the closed position. The actuator arm includes a handle portion 136 that extends substantially at a right angle with respect to the latching rod section 134. The latching rod section 134 and the handle portion 136 overlap the retention frame when the security grating 36 is in the closed position.

According to this arrangement, the actuator latching rod section 134 and the handle portion 136 are readily accessible to an occupant inside the building structure but cannot be observed through the window opening from a location external of the building structure. The latching rod section 134 of the actuator arm is dimensioned for an easy, sliding fit through the aligned bores of the latch receivers and is held in place by gravity. The handle portion 136 of the actuator is supported in overlapping relation with the horizontal retention bar 64 by an open retainer tray 138 that is attached to the inside face of the horizontal retention bar 64. The actuator rod portion 134 is positioned in overlapping relation with the vertical retention bar 74, and is thus concealed from outside view.

According to one aspect of the invention, a utility hook 140 is attached to the actuator handle 136 and overlaps the window opening at an easy-to-find location relative to the window when the releasable security grating 36 is closed and the actuator arm is in the locked position. The utility hook 140 serves as a reference point for quickly locating the handle by touch so that the latch can be released for emergency exit during hours of darkness or when the room is filled with smoke under zero visibility conditions.

The utility hook 140 can be used in the conventional way to suspend ornamental objects or living plants adjacent the window space. When so used, the utility hook 140 does not give away the presence of the releasable security grate 36 or the latching apparatus. Additional fixed utility hooks 140 are also installed on the fixed security gratings, thereby providing a uniform appearance when viewed externally, as shown in FIG. 5. By this arrangement, a potential intruder will not have any basis to differentiate one window with respect to the other, and thus would not be likely to detect the location of the releasable security grating 36 or the release apparatus.

Referring again to FIG. 2 and FIG. 3, the latch assembly is unlocked and the security grating 36 is released for movement simply by lifting the actuator arm 134 out of engagement with the latch receivers, thus allowing the security grating to be swung open to the emergency exit position as shown in FIG. 3. Because the release handle 136 and the attached hook 140 are maintained at a known position relative to the window opening, the release handle can be quickly located even when the room is filled with smoke under zero visibility conditions. The occupant can detect the main retention frame 48 and recognize by touch the repeating pattern of the nested guard frames.

This arrangement provides a point of reference that identifies the location of the release handle 136, which is maintained at a fixed location relative to the center of the releasable security grating 36. This determination is made first by detecting the main retention frame 48 and following one of the horizontal retention bars until reaching the vertical retention bar 74 that is laterally spaced from the left window jamb 16. The occupant can then easily detect the presence of the actuator rod 134 and the actuator handle 136. The security grating 36 is released by grasping the actuator handle 136 or hook 140 and lifting the actuator rod 134 completely clear of the latch receivers, as shown in FIG. 3. This permits the security grating 36 to swing into the interior of the building structure, thus providing immediate access to the lower window, which can then be unlocked and raised to open the emergency exit.

In the preferred embodiment, the nested guard frames 76, 78 are disposed substantially in coplanar relation with the linking bars 96, 98, 100, 102, and also substantially in concentric relation with each other, thereby forming a pleasing pattern that repeats identically from window-to-window. Because the movable release hook and the fixed utility hooks are identical in size and are located in the same window positions, a uniform appearance is presented to an outside observer, as shown in FIG. 5. Moreover, the release arm and latch receivers are concealed behind the retention frame 74. By this arrangement, a potential intruder will not have any basis to differentiate one window with respect to the other, and thus would not be likely to detect the location of the releasable security grating 36 or the release apparatus.

The main retention frame 48 is formed by sections of one inch square steel tubing, with the sections being welded together. The guard frames 76, 78 and linking bars are preferably formed of ¼ inch×½ inch flat steel stock. The horizontal frame segments are spaced on 5 inch centers throughout, and the vertical segments are likewise spaced on 5 inch centers throughout. The actuator arm is formed by ¼ inch outside diameter solid steel rod, arid the latch receivers are formed by ¼ inside diameter pipe sleeves. Preferably, the utility hooks 140 are integrally formed with the handle portion of the actuator arm, and have a length dimension of approximately 4 inches.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

I claim:

1. A quick release security guard assembly for installation in a protective position adjacent a window opening in a building structure comprising, in combination:

a retention frame;

a security grating;

a hinge assembly coupling the security grating to the retention frame to permit movement of the security grating from a closed position in which the security grating opposes entrance movement through the retention frame, to an open position permitting exit movement through the retention frame;

a latch assembly for releasably locking the security grating onto the retention frame in the closed position, the latch assembly including latch receivers mounted on and overlapping the retention frame and security grating, an actuator arm urged by the force of gravity into latched engagement with the latch receivers and a release handle attached to the actuator arm for manually disengaging the actuator arm from the latch assembly, wherein the actuator arm is disposed upright and overlaps a first portion of the retention frame in the protective position and the release handle extends substantially at a right angle to the actuator arm and overlaps a second portion of the retention frame; and a utility hook attached to the release handle, wherein the utility hook depends from the release handle and overlaps the window opening in the protective position, whereby the latch receivers, actuator arm and release handle are accessible to an occupant inside the building structure but are concealed from observers looking through the window opening from a location external of the building structure, and the utility hook and release handle can be quickly located and operated by an occupant to release the security grating during an emergency that may arise during hours of darkness or when the room is filled with smoke under zero visibility conditions.

2. The quick release security guard assembly as set forth in claim 1, including a retainer tray attached to the retention frame for holding the release handle in the overlapping position when the security grating is in the closed position.

3. The quick release security guard assembly as set forth in claim 1, wherein the latch assembly comprises:

a first latch receiver coupled to the retention frame and a second latch receiver coupled to the security grating, the first and second latch receivers being disposed in latching alignment with each other when the security grating is in the closed position; and the actuator arm is operatively coupled to the latch receivers for manually locking and releasing the latch assembly when the security grating is in the closed position.

4. The quick release security guard assembly as set forth in claim 3, wherein the first and second latch receivers comprise first and second tubular sleeves, respectively, the tubular sleeves being disposed in latching alignment with each other when the security grating is in the closed position, and the actuator arm comprises a rod that is extendable into and retractable out of the tubular sleeves when the security grating is in the protective position.

5. The quick release security guard assembly as set forth in claim 1, including a utility hook attached to the handle, the utility hook depending from the handle and overlapping the window opening so that the utility hook is exposed for view through the window opening from a location external of the building structure when the security grating is in the protective position.

6. The quick release security guard assembly as set forth in claim 1, wherein the security grating comprises a plurality of guard frames disposed in concentric relation, each guard frame including frame segments joined together in end-to-end relation thereby defining a polygon with three or more corners, and including linking bars extending obliquely to the frame segments and joining diagonally adjacent corners of the concentric guard frames.

7. The quick release security guard assembly as set forth in claim 6, wherein each guard frame comprises four frame segments interconnected to form a rectangle.

8. The quick release security guard assembly as set forth in claim 1, the actuator arm projecting substantially at a right angle with respect to the release handle, the actuator arm and the release handle overlapping the retention frame in the closed position whereby the release handle and actuator arm are accessible to an occupant inside the building structure but cannot be observed through the window opening from a location external of the building structure.

9. The quick release security guard assembly as set forth in claim 1, wherein the building structure comprises a wall, a window opening formed in the wall, a left jamb, a right jamb, a sill and a lintel attached to the wall thereby defining a rectangular window frame bordering the window opening, and the retention frame including:

horizontal and vertical frame segments forming a rectangular retention frame around a substantial portion of the window opening, the retention frame being dimensioned for installation within the window opening and inset from the rectangular window frame; and a plurality of flanges projecting from the retention frame for attaching the retention frame to the window frame.

10. In a building structure including a window frame formed around a window opening, the improvement comprising:

a retention frame assembly mounted on the interior of the building structure adjacent the window opening, the retention frame assembly including horizontal and vertical frame segments forming two or more retention frames disposed within the window opening;

a first utility hook attached to one of the horizontal frame segments, the first utility hook disposed in a position overlapping the window opening so that it may be viewed by observers looking through the window opening from a location external of the building structure;

a security grating coupled to one of the retention frame segments, the security grating being movable to a closed position overlapping the window opening, thereby opposing entrance movement through the window opening, to an open position thereby allowing exit movement through the window opening;

a latch assembly coupled to the retention frame and engagable with the movable security grating, the latch assembly including a latch receiver and a movable latching rod that is releasably engagable with the latch receiver for selectively locking and releasing the latch assembly;

the latching rod including a handle portion overlapping the retention frame when the security grating is in the protective position, whereby the handle portion is accessible to an occupant inside the building structure but cannot be observed through the window opening from a location external of the building structure; and a second utility hook attached to the handle portion, the second utility hook overlapping the window opening so that it can be viewed simultaneously with the first utility hook from a location exterior of the building structure when the latching rod is in the locked position.

11. The improvement as set forth in claim 10, wherein the security grating comprises a plurality of guard frames disposed in radially spaced, concentric relation, each guard frame including frame segments joined together in end-to-end relation thereby defining a polygon with three or more corners, and including linking bars joining diagonally adjacent corners of the concentric guard frames.

12. The improvement as set forth in claim 10, wherein the concentric guard frames each comprise frame segments interconnected to form a rectangle.

13. In a building structure including a window frame installed around a window opening, the improvement comprising:

a retention frame mounted on the interior of the building structure adjacent the window opening, the retention frame including horizontal and vertical frame segments thereby forming a plurality of rectangular retention frames, with each retention frame forming a partitioned window space within the window opening;

a utility hook attached to one of the retention frame segments and depending therefrom in a position that exposes the utility hook for viewing by observers looking through the partitioned window space from a location external of the building structure;

a security grating coupled to one of the frame segments, the security grating being movable to a closed position overlapping the partitioned window space, thereby opposing entrance movement through the partitioned window space, to an open position thereby allowing exit movement through the partitioned window space;

a latch assembly coupled to the retention frame and engagable with the movable security grating, the latch assembly including a latch receiver and a movable latching rod that is releasably engagable with the latch receiver for selectively locking and releasing the latch assembly;

the latching rod including a handle portion concealed by the retention frame when the security grating is in the closed position whereby the handle portion is accessible to an occupant inside the building structure but cannot be observed through the partitioned window space from a location external of the building structure; and the security grating includes a plurality of guard frames disposed in concentric relation, each guard frame including frame segments joined together in end-to-end relation thereby defining a polygon with three or more corners, and including linking bars joining diagonally adjacent corners of the concentric guard frames.

14. The improvement as set forth in claim 13, wherein each guard frame comprises four frame segments interconnected to form a rectangle.

15. A security grating assembly comprising, in combination:

a retention frame adapted for attachment to a building structure in a protective position adjacent a window opening in the building structure, the retention frame including horizontal and vertical frame segments bordering a substantial portion of the window opening when the retention frame is attached in the protective position, the retention frame being dimensioned for installation within the window opening and inset from the rectangular window frame when installed in the protective position;

a security grating including a plurality of guard frames disposed in concentric relation with each other, each guard frame including frame segments joined together in end-to-end relation thereby forming a polygon with three or more corners, and including linking bars extending obliquely to the frame segments and joining diagonally adjacent corners of the concentric guard frames;

a hinge assembly coupling the security grating to the retention frame to permit movement of the security grating from a closed position in which the security grating opposes entrance movement through the retention frame, to an open position permitting exit movement through the retention frame;

a latch assembly for releasably locking the security grating onto the retention frame assembly in the closed position, the latch assembly including latch receivers mounted on the retention frame and security grating, an actuator arm urged by the force of gravity into latched engagement with the latch receivers and a release handle attached to the actuator arm for manually disengaging the actuator arm from the latch assembly, wherein the actuator arm is disposed upright and overlaps a first portion of the retention frame in the protective position and the release handle extends substantially at a right angle to the actuator arm and overlaps a second portion of the retention frame; and a utility hook attached to the release handle, wherein the utility hook depends from the release handle and overlaps the window opening in the protective position, whereby the latch receivers, actuator arm and release handle are accessible to an occupant inside the building structure but are concealed from observers looking through the window opening from a location external of the building structure, and the utility hook and release handle can be quickly located and operated by an occupant to release the security grating during an emergency that may arise during hours of darkness or when the room is filled with smoke under zero visibility conditions.

* * * * *